US005313674A

United States Patent [19]

Chiang et al.

[11] Patent Number: 5,313,674

[45] Date of Patent: May 24, 1994

[54] FLUSHING DEVICE

[76] Inventors: Sing Chiang, 4th Floor, No. 19, Lane 60, Chunghua Rd., Hsintien City, Taipei Hsien; Chin-Hua Hsieh, No. 1, Lane 103, Yungtai St., Chungli City, Tao-yuan Hsien, both of Taiwan

[21] Appl. No.: 901

[22] Filed: Jan. 6, 1993

Related U.S. Application Data

[63] Continuation of Ser. No. 807,310, Dec. 13, 1991, abandoned.

[51] Int. Cl.[5] ..... E03D 5/10

[52] U.S. Cl. ..... 4/406

[58] Field of Search ..... 4/313, 324–327, 4/405–415

[56] References Cited

U.S. PATENT DOCUMENTS

| | | | |
|---|---|---|---|
| 2,813,274 | 11/1957 | Lewis et al. | 4/313 |
| 3,462,768 | 8/1969 | Lefebvre et al. | 4/406 |
| 4,392,260 | 7/1983 | Bensen | 4/406 X |
| 5,003,643 | 2/1991 | Chung | 4/406 X |
| 5,083,323 | 1/1992 | Cannan | 4/415 |

*Primary Examiner*—Charles E. Phillips

*Attorney, Agent, or Firm*—Robbins, Berliner & Carson

[57] ABSTRACT

A flushing device for toilets has a supporting assembly and a driving mechanism. The supporting assembly supports the driving mechanism in a tank of a toilet by use of adjustable beams which span the tank and a bridge plate which connects to the beams. The driving mechanism has an infrared sensor placed on a wall behind the tank, a motor contained in a waterproof housing and a disk connected to the motor by a shaft. The disk engages with a conventional flushing assembly sited in the tank. The sensor actuates the motor to rotate when the sensor detects the presence and exit of a user, thereby flushing the toilet.

3 Claims, 6 Drawing Sheets

FLUSHING DEVICE

This application is a continuation of application Ser. No. 07/807,310, filed Dec. 31, 1991, now abandoned.

BACKGROUND OF THE INVENTION

1. Field of the Invention

The present invention relates to a toilet and, more particularly, to a flushing device employing an infrared sensor to automatically flush the toilet.

2. Description of Related Art

Infrared sensors have been widely employed in public restrooms so as to increase the cleanness thereof, making them more sanitary for the individual users. The sensors have been adapted for use on hand dryer, faucets and urinals, eliminating the need for a user to make physical contact to operate these different fixtures.

Presently, there has not been a flushing device for toilets which successfully adapts an infrared sensor so as to flush the toilet automatically after use. Therefore, in order to make a public restroom completely "hands free", there is a need for a flushing device which employs an infrared sensor.

SUMMARY OF THE INVENTION

Accordingly, it is an object of the present invention to provide a flushing device which uses a sensor to detect whether a toilet has been used and to flush the toilet thereafter.

It is another object of the present invention to provide a flushing device which has a supporting means which is adjustable so as to fit existing toilet tanks.

It is still another object of the present invention to provide a flushing device which is also manually activatable.

It is yet another object of the present invention to provide a flushing device which is adaptable to a number of different types of existing toilets with different tanks and flushing assemblies.

Other objects, advantages and novel features of the present invention will become more apparent from the following detailed description when taken in conjunction with the accompanying drawings.

DETAILED DESCRIPTION OF THE PREFERRED EMBODIMENTS

Figure 1:
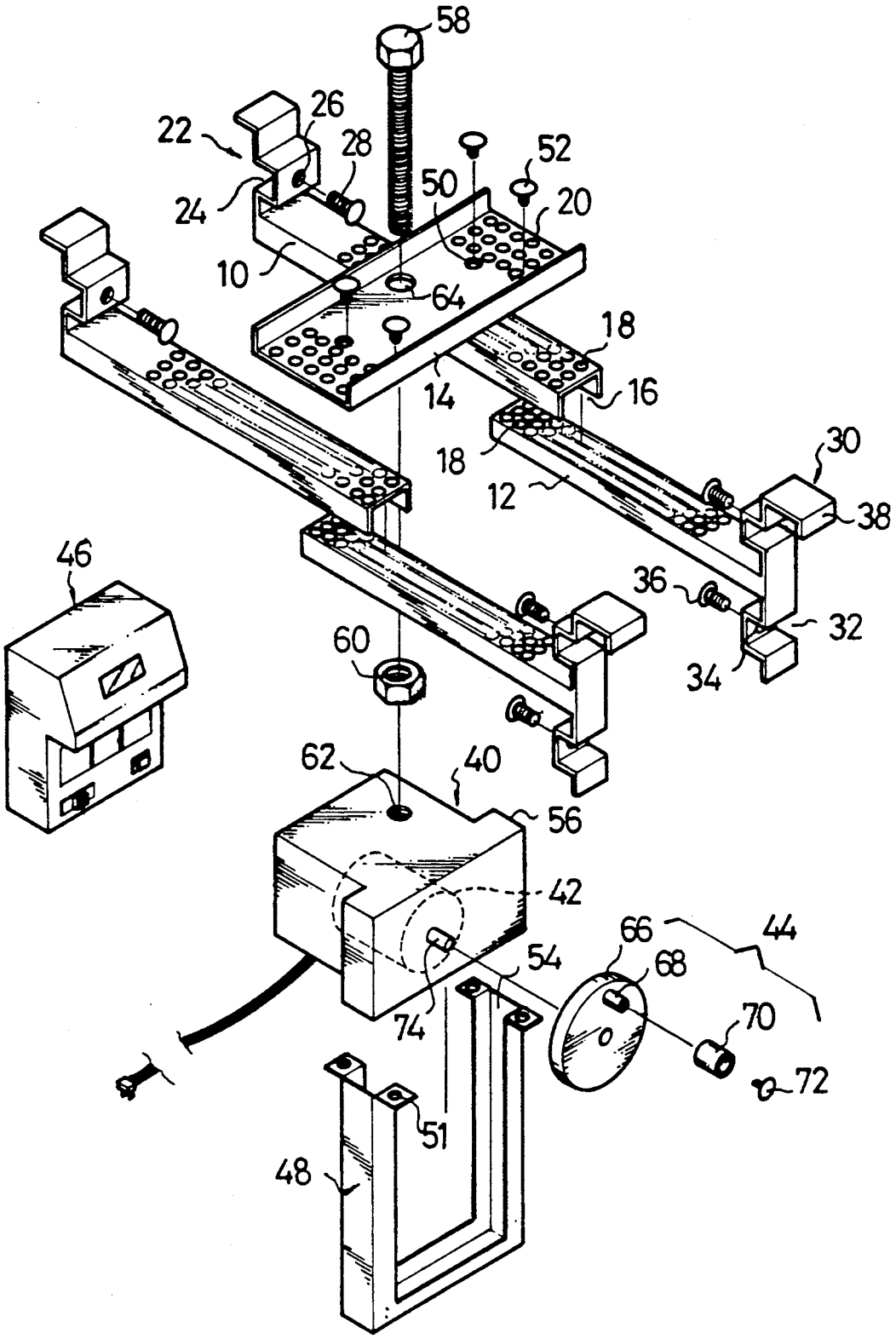
FIG. 1 is an exploded view of a flushing device in accordance with the present invention.
Figure 2:
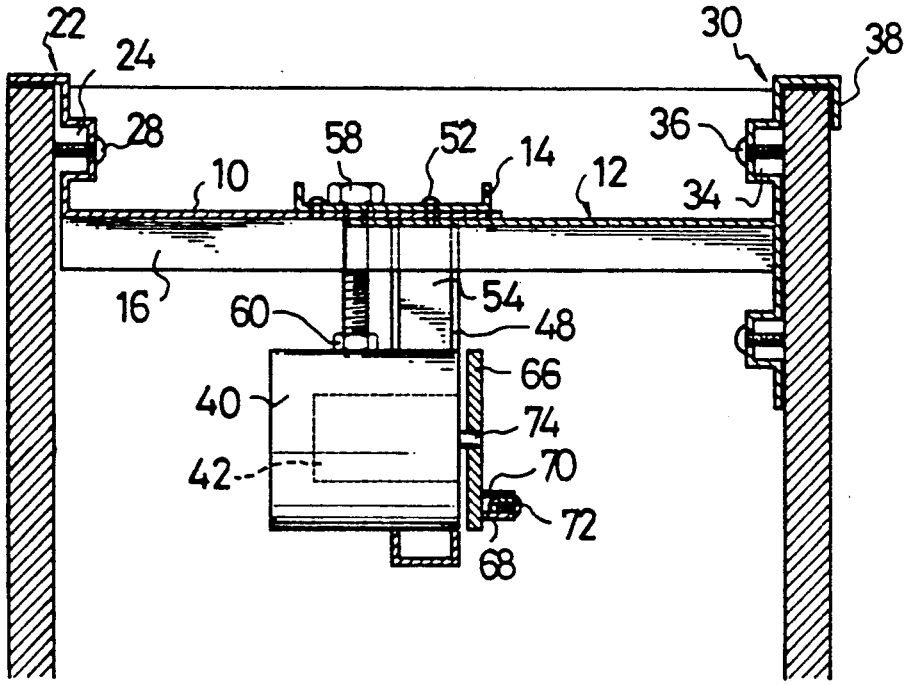
FIG. 2 is a side view of a flushing device in accordance with a preferred embodiment of the present invention, installed in a toilet tank.

Now referring to the drawings, initially to FIGS. 1 and 2, a flushing device in accordance with a preferred embodiment of the present invention comprises an adjustable supporting means and a driving means. The supporting means substantially comprises a pair of primary beams 10, a pair of secondary beams 12 and a bridge plate 14. For the sake of clarity, reference numerals are only indicated on one pair of the primary and secondary beams 10 and 12, both the corresponding elements on the other pair are identical.

The primary beams 10 each have a rectilinear channel 16 formed in an underside thereof which slidably receives a secondary beam 12 therein. The primary and the secondary beams 10 and 12 each have a multiplicity of holes 18 formed therein in a matrix-like fashion, such as a $3 \times N$ as shown. Correspondingly, the bridge plate 14 has a plurality of holes 20 formed in ends thereof in a matrix-like fashion, such as a $3 \times 5$ as shown. The holes 18 and 20 allow the supporting means to be adjustable both transversely and longitudinally. Fastening means such as screws (not shown for the sake of clarity) are secured in holes 20 and 18 so as to secure the primary and secondary beams 10 and 12 and the bridge plate 14 in a desired position.

The primary beams 10 each further comprise a bracket means 22 sited on one end thereof for engaging with a side wall of a toilet tank, as particularly shown in FIG. 2. Each bracket means 22 essentially comprises a top portion which rests on a top of the side wall and an adjusting portion consisting of a pocket 24, a threaded hole 26 and an adjusting screw 28, which will be discussed later.

The secondary beams 12 each further comprise a bracket means 30 sited on one end thereof for engaging with another side wall of the toilet tank, as particularly shown in FIG. 2. Each bracket means 30 essentially comprises a top portion which rests on a top of the side wall and a pair of adjusting portions each consisting of a pocket 32, a threaded hole 34 and an adjusting screw 36 (reference numerals only being shown on one), which will be discussed later. Each bracket means 30 may further and preferably comprise a lip 38 formed on the upper portion thereof, projecting perpendicularly downward to a front side of the side wall of the toilet tank.

Particularly referring to FIG. 2, the function of the adjusting portions of the bracket means 22 and 30 is to provide added support and rigidity to the supporting means when in place in the toilet tank. After the primary and secondary beams are adjusted to an approximate size of the toilet tank and the bridge plate 14 is secured thereto, the adjusting screws 28 and 36 may be tightened into the through holes 26 and 34, respectively, so as to take up any slack in order to insure a secure fit. The pockets 24 and 32 provide the adjusting screws 28 and 36 room for adjustment.

With contained reference to FIGS. 1 and 2, the driving means generally comprises a waterproof housing 40, a motor 42 contained in the housing 40, a rotor means 44 and an infrared sensor 46.

Figure 3:
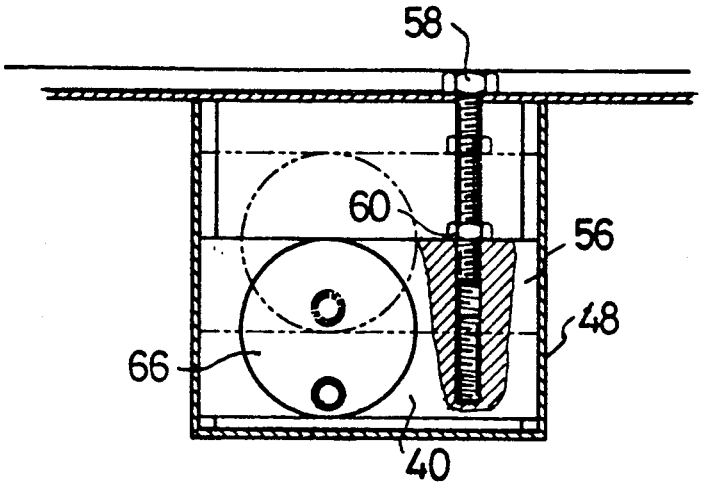
FIG. 3 is a partially cross-sectional view of a holder means in accordance with the present invention.

The housing 40 is secured to the supporting means by a securing means essentially consisting of a U-shaped brace 48 which has a plurality of holes 51 in two ends thereof, a corresponding number of holes 50 in the bridge plate 14 and a corresponding number of screws 52. The brace 48 has a receiving channel 54 formed therein for slidably receiving a protruding portion 56 of the housing 40 therein. The screws 52 are each inserted through a corresponding hole 50 and secured in a corresponding hole 51. Thus, the housing 40 is secured to the supporting means. The securing means further comprises a threaded bolt 58, a threaded nut 60 and a receiving hole 62 formed in a top of the housing 40. The bolt 58 is inserted through a hole 64 formed in the bridge plate 14 and secured in the receiving hole 62, and the threaded nut 60 is tightened against the top of the housing 40, adjusting and anchoring the housing 40 in a desired height in the receiving channel 54, as shown in FIG. 3.

The motor 42 is electrically connected to the sensor 46 which is placed outside of the toilet tank. The rotor means 44 substantially comprises a disk 66 which has a pin 68 sited thereon at a position distant from the center thereof and a tubular element 70 which is rotatably attached to the pin 68 by a screw 72. The disk 66 is fixed to and driven by means of a shaft 74 of the motor 42, which will be discussed later.

Figure 4:
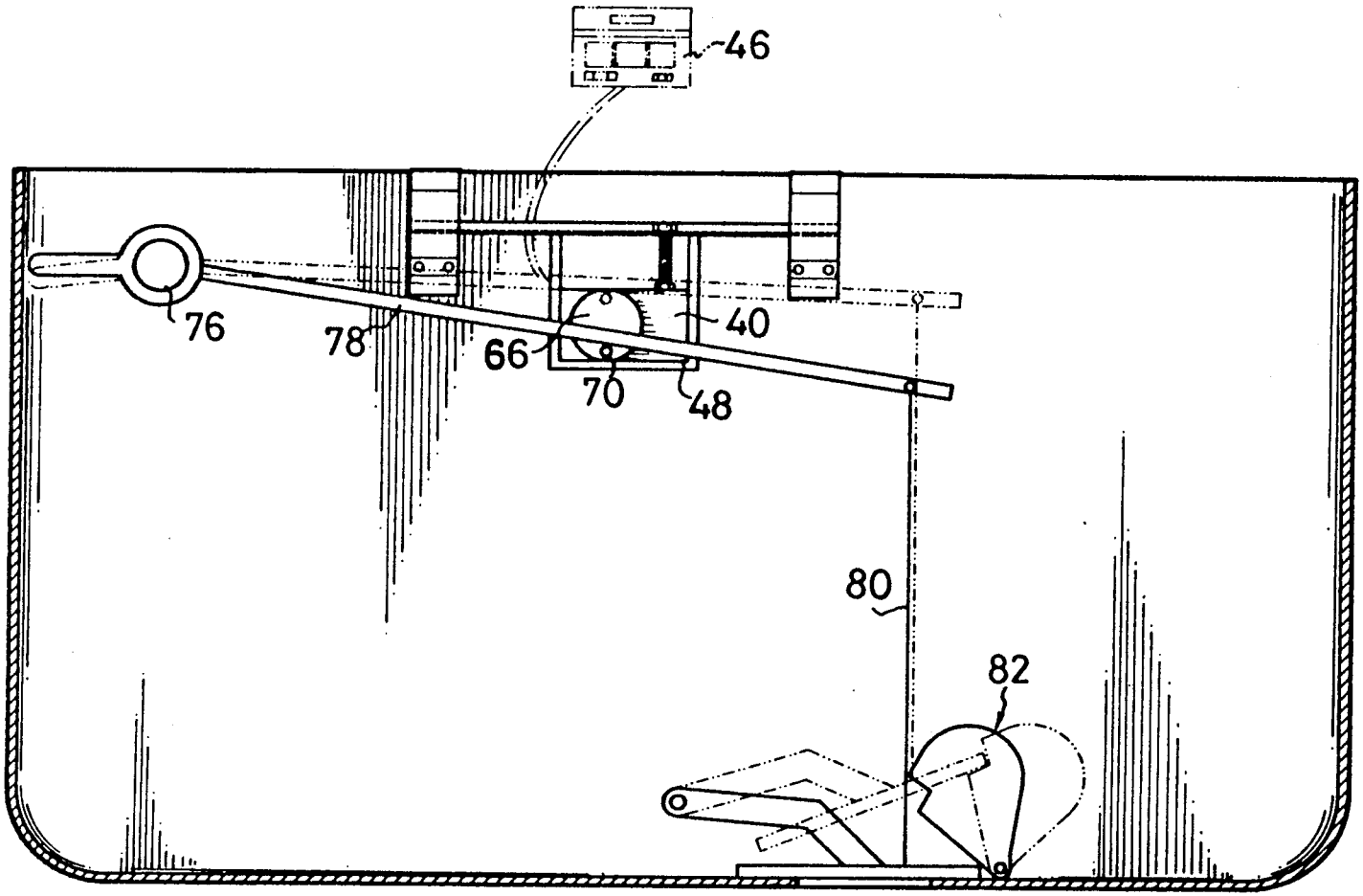
FIG. 4 is a front view of the flushing device in accordance with the preferred embodiment of the present invention, coupling with a first type of conventional flushing assembly.

Further referring to FIG. 4, a conventional rotating-handle flushing assembly comprises at least a handle 76 fixed to a lever arm 78 which is attached by a line 80 to a valve means 82 for sealing a hole defined in the bottom of the toilet tank. The sensor 46 is positioned on a wall behind the toilet tank at a level which is in line with an expected position of a user, as shown in phantom line.

The flushing device is sited in a conventional toilet tank. The supporting and driving means are sited in the toilet tank. The rotor means is so adjusted that the tubular element 70 is in a lowermost position when the valve means 82 seals the hole in the bottom of the toilet tank. Preferably, the line 80 is slightly stressed.

In operation, when the sensor 46 detects the presence of a user, it activates the motor 42 in order to rotate the shaft 74, accordingly the disk 66, either after the user has vacated the area or after a predetermined amount of time. The tubular element 70 is moved to an uppermost position, i.e., twelve o'clock, as shown in phantom line. The lever arm 78 is raised by the rotor means 66 as it rests on the tubular element 70. The valve means 82 is activated in order to release water from the toilet tank for flushing the toilet. For the tank to be refilled with water, i.e., the valve means 82 seals the hole, either (1) the sensor activates the motor 42 to rotate the tubular element 70 to the lowermost position after the tubular element 70 has been retained in the uppermost position for a predetermined amount of time; or (2) the motor 42 makes a complete revolution at a speed which allows all the water contained in the toilet tank to flow thereout, returning to the lowermost position.

Figure 5:
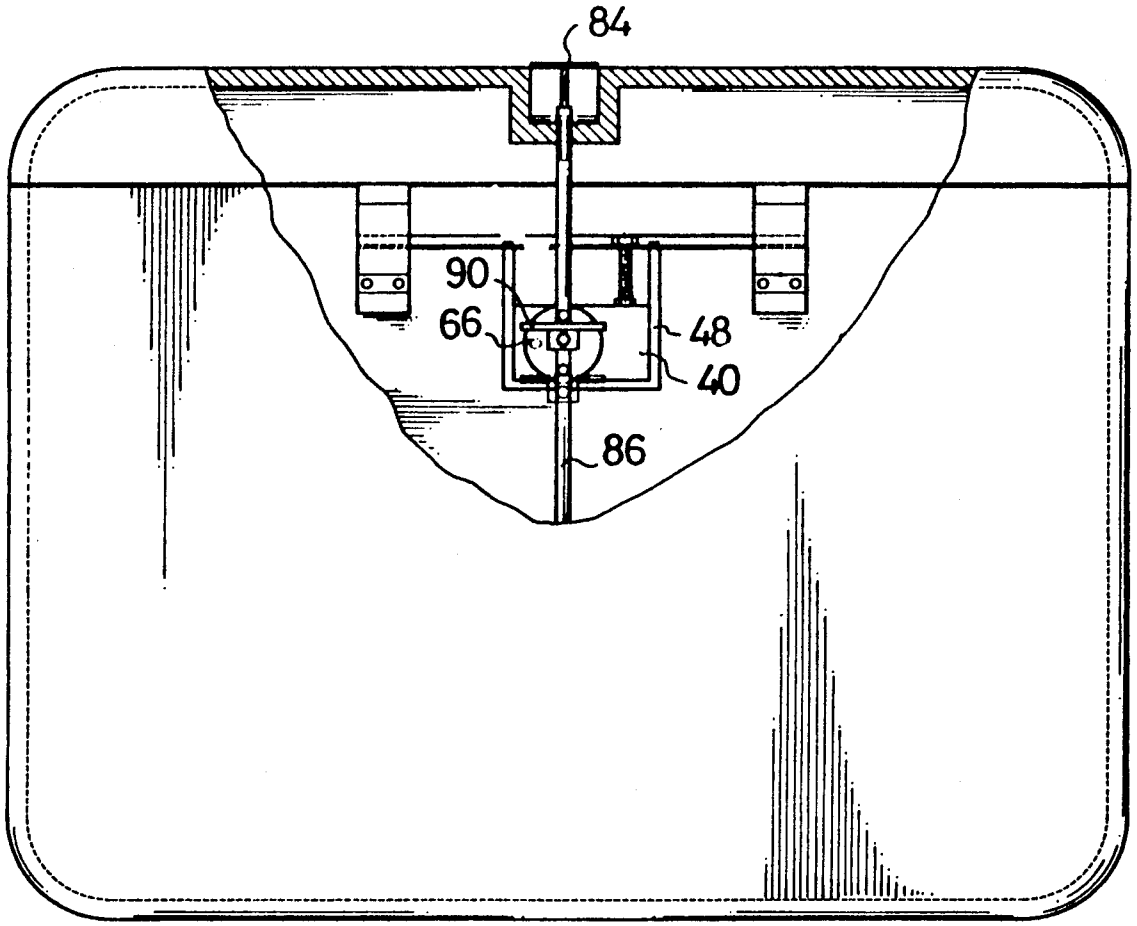
FIG. 5 is a front view of the flushing device in accordance with the preferred embodiment of the present invention, coupling with a second type of conventional flushing assembly.

With reference to FIG. 5, a conventional push-button flushing assembly comprises at least a push button 84 and a shaft 86 cooperating with a valve means (not shown). A coupling means 90 is attached to the shaft 86 so that the flushing device in accordance with the present invention can be incorporated with the push-button flushing assembly.

Figure 6:
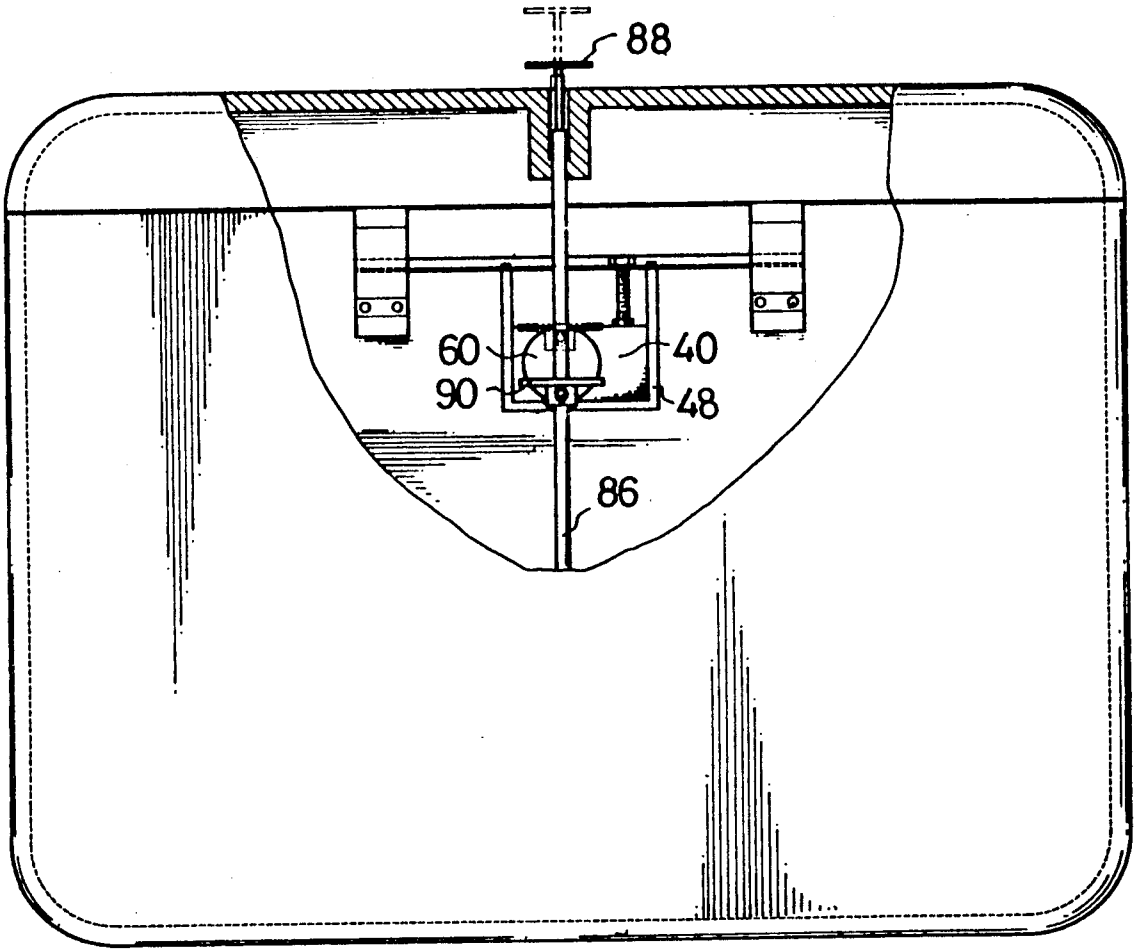
FIG. 6 is a front view of a flushing device in accordance with another preferred embodiment of the present invention, coupling with a third type of conventional flushing assembly.

With reference to FIG. 6, a conventional pull-knob flushing assembly has a pull button 88 and a shaft 86 cooperating with a valve means (not shown). The coupling means 90 is also used.

Figure 7:
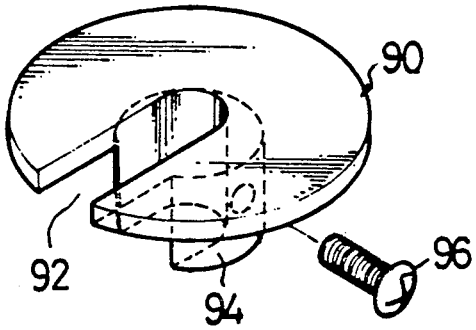
FIG. 7 is a perspective view of a coupling means used for the second and third types of toilet tanks.

With further reference to FIG. 7, a coupling means 90 has a plate-shaped portion and a collar-shaped portion 94. A slot 92 is formed in the coupling means 90. In use, the shaft is received in the slot 92. A screw 96 engages with and extends through a threaded hole in the collar 94 for attaching the coupling means 90 to the shaft. In the push-button flushing assembly of FIG. 5, the tubular element 70 is sited on the plate-shaped portion of the coupling means 90. In a pull-button flushing assembly of FIG. 6, the tubular element 70 is sited below the plate-shaped portion of the coupling means 90.

It is to be understood, however, that although numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A flushing device for a toilet having a water tank and a valve device having a sealing position and a flushing position in the water tank, comprising:

a sensor for detecting the presence of a user of the toilet;

a driving means actuatable by said sensor for moving the valve device from the sealing position to the flushing position comprising:

a housing;

a motor being mounted in said housing and actuatable by said sensor;

a shaft extending from said motor through said housing and being rotatable by said motor;

a disk being attached to and rotatable by said shaft; and a pin extending from said disk so that when said disk is rotated, said pin will move to one of an upper or lower position with respect to said valve device with one of the upper and lower positions corresponding to the flushing position of the valve device; and a supporting means for supporting said housing at any point in a plane between an upper level and a lower level.

2. A flushing device in accordance with claim 1 wherein:

a housing comprises:

two vertical limbs; and a top defining a threaded hole;

said supporting means comprises:

a pair of telescopic arms spanning the water tank;

a bridge plate being mounted on said pair of telescopic arms and defining a hole;

a U-shaped brace being mounted below said bridge plate and having two vertical channels for receiving said vertical limbs of said housing;

a threaded bolt passing through said hole defined in said bridge plate and engaging with said threaded hole defined in said housing, said housing being adjusted to a desired level with said vertical limbs sliding along said vertical channels when said threaded bolt is rotated; and a threaded nut engaging with said threaded bolt and abutting said top of said housing for firmly retaining said housing on the desired level.

3. A flushing device for a toilet having a water tank and a valve device having a sealing position and a flushing position in the water tank, comprising:

a sensor for detecting the presence of a user of the toilet;

a housing having a top defining a threaded hole and two vertical limbs;

a motor being mounted in said housing and actuatable by said sensor;

a shaft extending from said motor through said housing and being rotatable by said motor;

a disk being attached to and rotatable by said shaft;

a pin extending from a point distal from the center of said disk so that when said disk is rotated said pin will move to one of an upper or lower position with respect to said valve device, so as to move said valve device from a sealing position to a flushing position, one of said upper and lower positions corresponding to the flushing position of the valve device;

a pair of telescopic arms spanning the tank;

a bridge plate being mounted on said pair of telescopic arms and defining a hole;

a U-shaped brace being mounted below said bridge plate and having two vertical channels for receiving said vertical limbs of said housing;

a threaded bolt passing through said hole defined in said bridge plate and engaging with said threaded hole defined in said housing, said housing being adjusted to a desired level with said vertical limbs sliding along said vertical channels when said threaded bolt is rotated; and a threaded nut engaging with said threaded bolt and abutting said top of said housing for firmly retaining said housing on the desired level.

* * * * *